United States Patent [19]

Evans

[11] Patent Number: 4,509,649

[45] Date of Patent: Apr. 9, 1985

[54] CART WITH PLASTIC TOOLHOLDER

[75] Inventor: Robert J. Evans, Shorewood, Ill.

[73] Assignee: Aurora Equipment Company, Aurora, Ill.

[21] Appl. No.: 408,141

[22] Filed: Aug. 18, 1982

[51] Int. Cl.[3] ..... A47F 7/00

[52] U.S. Cl. ..... 211/70.6; 211/69; 403/374; 248/243

[58] Field of Search ..... 211/60 T, 208, 187, 211/1.5, 69, 88, 103; 280/79.3; 403/374, 409; 248/243

[56] References Cited

U.S. PATENT DOCUMENTS

| | | | |
|---|---|---|---|
| 3,170,742 | 2/1965 | Berkowitz | 248/243 X |
| 3,472,303 | 10/1969 | Beard | 411/408 X |
| 3,529,859 | 9/1970 | Garezynski | 403/374 X |
| 3,633,949 | 1/1972 | Pfluger | 403/374 X |
| 3,819,058 | 6/1974 | Reis | 211/162 X |
| 4,155,460 | 5/1979 | Ratti | 280/79.3 X |

FOREIGN PATENT DOCUMENTS

| | | | |
|---|---|---|---|
| 1021787 | 3/1966 | United Kingdom | 211/69 |

OTHER PUBLICATIONS

Lista International Corporation, Catalog N/C 80 (Cover Letter, Mr. Emerson R. Davis, 2/1/84).

*Primary Examiner*—Ramon S. Britts
*Assistant Examiner*—Blair M. Johnson
*Attorney, Agent, or Firm*—Hill, Van Santen, Steadman & Simpson

[57] ABSTRACT

A portable cart mounted on wheels and having a frame with spaced upright walls mounted thereon. Portable trays are mounted between the spaced upright walls. Means secures the trays in detachable assembly with the spaced upright walls. An improved series of toolholders is mounted in assembly on the portable trays. Each of the toolholders has a central tubular section for receiving an elongated tool in supported assembly therewith. The toolholder has one of its sides provided with a recessed area. A clamp block is mounted in the recessed area between the toolholder and the tray. The clamp block and the recessed area have upright matching engaged surfaces slidable relative to one another. A thumb screw is mounted on the toolholder and extended through and engaged in threaded assembly with the wedge block. The wedge block is oriented and constructed so as to cause relative movement between the upright matching engaged surfaces to firmly wedge the wedge block and toolholder and tray in snug fixed assembly together. The turning of the thumb screw is effective to cause the relative movement between the inclined surfaces to either fixedly secure or to release the toolholder from the tray.

17 Claims, 8 Drawing Figures

CART WITH PLASTIC TOOLHOLDER

The present invention relates generally to carts for transporting tools or other materials from one work station to another work station. The cart may be of the push or pull type or self powered. According to important features of this invention, a new and improved toolholder is provided on the cart which can be rigidly secured to a portable tray and which functions to support the toolholder on the cart. It is also believed that the cart and the portable tray embody new and improved features.

When manufacturing heavy machine tools, it is necessary to move the tools from one machine to the next machine for different types of machining operations. When the tools are carried on a cart the tools are top heavy and also are quite expensive.

In the past, some difficulty has been experienced in transporting tools of this type for there has been a tendency for the toolholder to tip over as the cart is being moved. Where toolholders are tipped, expensive tools can be damaged. A fully loaded push cart can carry many thousands of dollars worth of tools and, hence, it is important to avoid industrial accidents of the type described.

Different approaches have been adopted by industry in an effort to prevent the holders from tipping over. As an example, set screws have been employed for anchoring the toolholders in place, but tools are required to effect release of the holders.

According to important features of this invention, a new and improved construction has been developed which functions very easily in that the toolholder is provided with a knurled thumb screw which can be manually tightened by hand to rigidly secure the holder in rigid assembly with a tray to prevent tipping.

An important object of this invention is to provide a new and improved toolholder that can be fixed in place on a portable tray carried by a cart so that it cannot move relative to the cart.

Important features of the present invention include a portable cart mounted on wheels and having a frame with spaced upright walls mounted thereon, portable trays mounted between the spaced upright walls and means securing the trays in detachable assembly with the spaced upright walls, the improvement of a series of toolholders in mounted assembly on the portable trays, each of the toolholders having a central tubular section for receiving an elongated tool in mounted assembly therein, the toolholder having one of its sides provided with a recessed area, a clamp or wedge block mounted in the recessed area between the toolholder and the tray, the clamp or wedge block and the recessed area having upright matching engaged surfaces slidable relative to one another, and a thumb screw mounted on the toolholder and extended through and engaged in threaded assembly with the wedge block and being so oriented and constructed as to cause relative movement between the upright matching engaged surfaces to firmly wedge the clamp or wedge block and toolholder and tray in snug fixed assembly together, the turning of the thumb screw being effective to cause relative movement between the inclined surfaces to either fixedly secure or to release the toolholder from the tray.

Other features of the invention relate to the new and improved tubular section for supporting a tool on the work holder.

Other features of the present invention concern the simple, effective clamp block construction that is provided to hold the toolholder in fixed position on the portable tray so as to prevent the toolholder from moving relative to the tray and possibly damaging the tool carried by the tray holder.

Other objects and features of this invention will more fully become apparent in view of the following detailed description of the drawings illustrating the single embodiment and wherein.

DETAILED DESCRIPTION OF THE DRAWINGS

Figure 1:
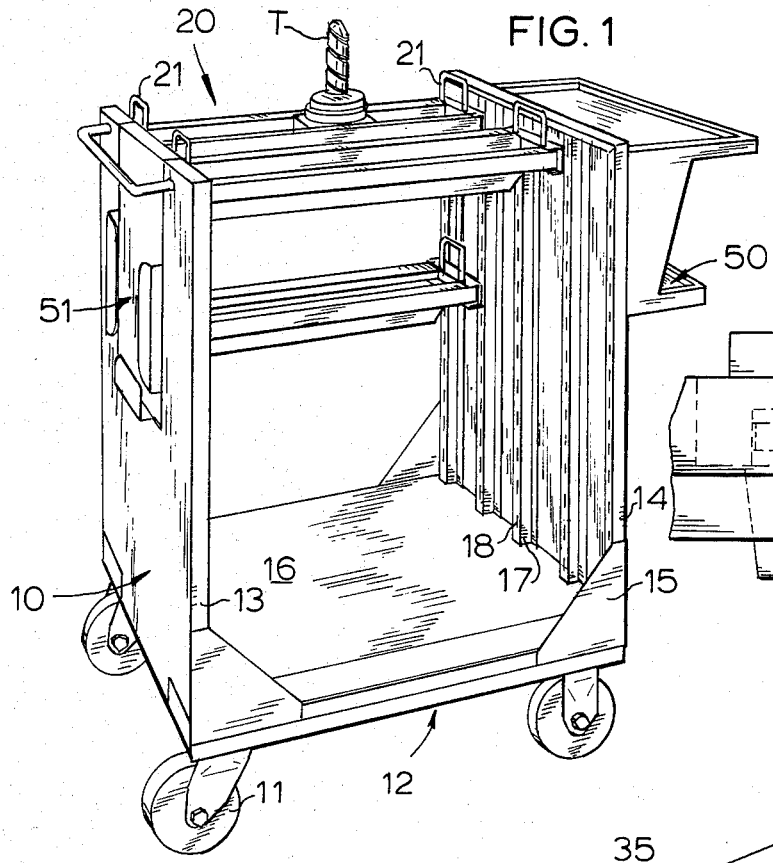
FIG. 1 is a perspective view of a portable push cart embodying features of my invention.

The reference numeral 10 indicates a portable push cart which embodies features of my invention. The cart 10 is mounted on four conventional caster type wheels 11 and has a frame 12 supported by the wheels. Mounted on the frame are spaced rear and front upright walls 13 and 14. As seen in FIG. 1, the upright walls 13 and 14 are secured by braces 15 to a cart base 16.

The rear and upright walls include confronting columnar supports 17 each having a series of vertically spaced slots 18. Mounted between the front and rear walls 13 and 14 are a series of tool supporting portable trays 20 preferably formed from sheet metal. Each tray has handles 21 at opposite ends to facilitate transport of the tray and contents when detached from the cart 10.

The tray 20 is of a box shape and includes stepped shaped rails or sides 22 and 23 carrying tool supporting ledges 24 and 25 which are formed in integral assembly with the associated sides 22 and 23. The sides 22 and 23 are joined at opposite ends by C-shaped sheet metal tray ends 28 and 29. The opposite ends of the sides 22 and 23 are partially cut-away (FIG. 4) so as to extend into the C-shaped tray ends and are secured in any suitable manner such as by welds and the like to the tray ends 28 and 29 to form a unitary structure. The cut-away step flange areas are identified at 26—26 (FIG. 4) on each rail. As stated before, the tray 20 is provided with handles 21 at opposite ends and these handles are secured in a fixed relation to the tray ends 28 and 29.

Figure 2:
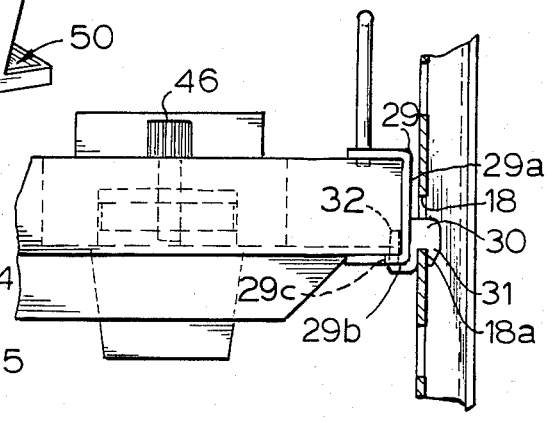
FIG. 2 is an enlarged fragmentary partially sectioned view illustrating the new and improved work holder and the manner in which the tray carrying the work holder is mounted on the cart.
Figure 3:
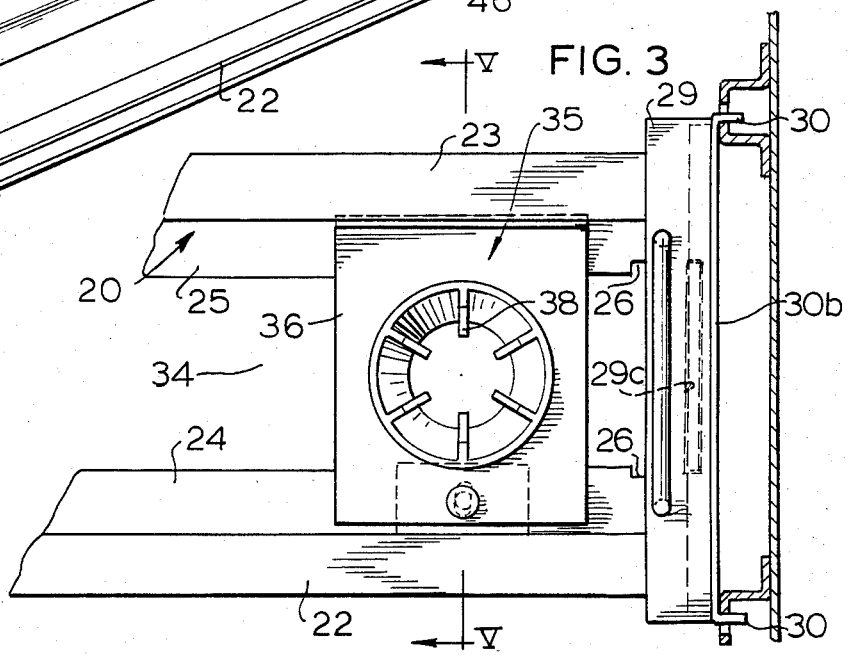
FIG. 3 is an enlarged fragmentary partially sectioned plan view of the toolholder and tray.

In order to assemble the trays 20 to the cart rear and front walls 13 and 14, the tray 20 is provided with a series of attachment clips 30 (FIG. 2). These attachment clips 30 coact with the slots 18 located at each end of each tray to thereby support and connect the trays to the cart. It will be noted that the vertical extent of the slots is such that the hook-shaped clips can freely pass through the slots and then a hook or hook-shaped end 31 of the clip 30 engages in hooked relation with a bottom edge 18*a* of the slot 18. In the preferred embodiment of my invention, the hooks 31 at each end of the tray 20 are formed integral as one piece and are linked together by a connecting clip section 30*b* (FIG. 3) which abuts against a forward face 29*a* and a bottom face 29*b* (FIG. 2) of the associated tray end 29. The clips 30 work in the same way with tray end 28. The clips 30 also possess a locking clip leg 32 (FIG. 2), that is turned into tray end slot 29*c*. The slot in tray end 28 is not shown, but is identical. Thus, the clips are all locked in assembly with the tray ends 28 and 29 against accidental detachment. As indicated, the C-shaped or channel-shaped tray ends provide a very sturdy connector for joining sides 22 and 23 of the tray in spaced assembly leaving a tray slot 34 between the ledges 24 and 25.

Mounted top side of the ledges 24 and 25 is a toolholder 35. These ledges 24 and 25 support the toolholder on the tray 20. The toolholder, as illustrated in my invention, is preferably comprised of synthetic plastic material and includes a central main toolholder section 36 (FIG. 5) and a wedge or clamp block 37. The toolholders are adapted to carry taper shanked or straight shanked tools (T) (FIG. 1). The tubular tool-supporting section 36 includes an upper rim 36*a* which extends above an outer margin of the main section indicated at 36*b*. The tubular section further includes an intermediate tubular section 36*d* and a tubular lower end section 36*e*. Thus, when a tool is mounted on the toolholder as seen in FIG. 1, it will extend through the various tubular sections 36*a*, 36*d*, and 36*e*, and be supported by these sections through the tray and end walls of the cart. When the tools T are mounted on the toolholders 35 it will be appreciated that the tools can extend not only through the holder (FIG. 5) but also between the rails 22—23 of the tray so as to be positioned with opposite ends of the tool being above and below the tray 20.

In order to support the tools T the toolholder has a series of frusto-conical ribs 38 which are disposed at the outside dimension of the frusto-conical orifice defined by the various tubular sections 36*a*, 36*d* and 36*e*.

Figure 4:
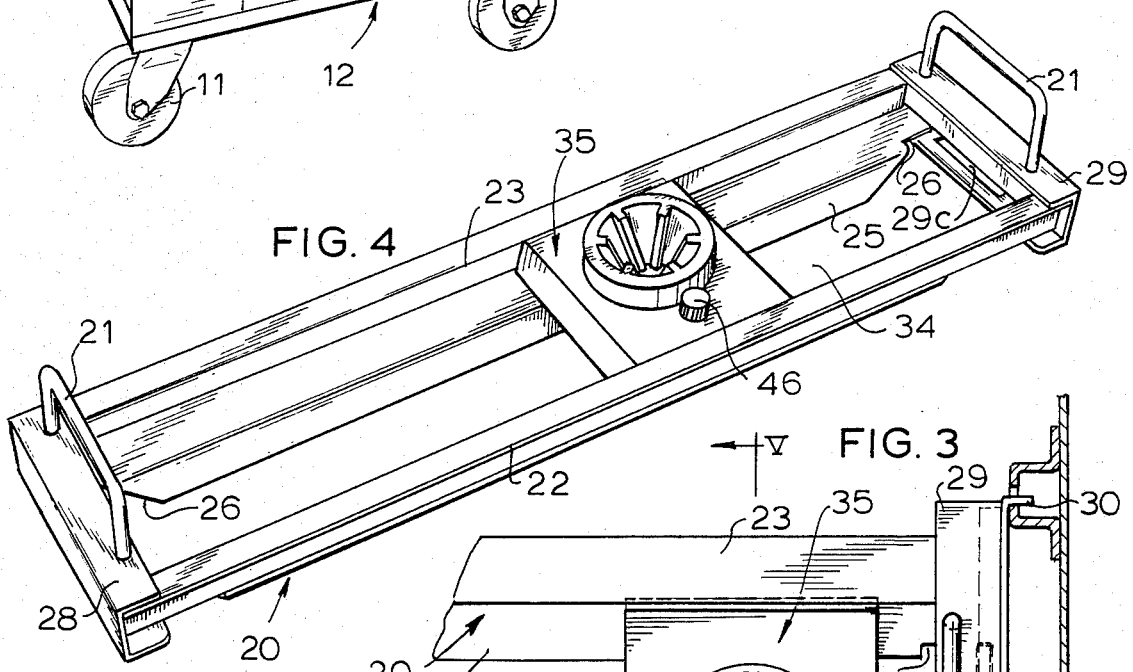
FIG. 4 is a perspective view of the tray and toolholder assemblage.
Figure 8:
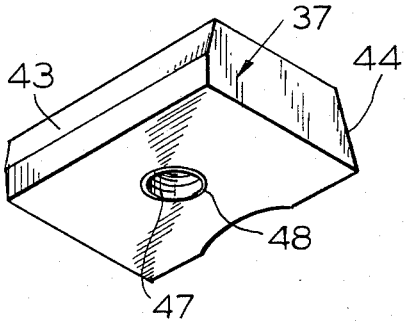
FIG. 8 is an enlarged fragmentary view of a clamp block for use with the toolholder.

The toolholders are each provided with opposed toolholder margins 39 and 40 with margin 40 being of a thinner vertical dimension than the margin 39. When the toolholder 35 is mounted in the tray 20 as seen in FIG. 4 and also FIG. 5, the underside of the toolholder 35 is adapted to be supported by the tray ledges 24 and 25. Thus, the toolholder rides on the ledges 24 and 25 and floats thereon unless it is positively fixed in position. In order to fix the position of the toolholder on the tray, the toolholder is provided with a thumb screw 45 having a knurled head 46. The thumb screw 45 extends through a threaded metal sleeve 47 provided in a formed opening 48 in the wedge block 37 (FIG. 8).

A recessed area or chamber 41 in the toolholder and the wedge block 37 have opposed marginal inclined surfaces 43 and 44 which are adapted to be slidingly engaged and relatively movable through the manual operation of the knurled head 46 on the thumb screw 45.

When it is desired to fix the position of the toolholder 35 on the tray 20, the thumb screw 45 is manually operated to move the wedge block 37 vertically upwardly with the matched engaged marginal surface 40' and 44 being movable relative to one another. At this point in time, as the engaged inclined surfaces are moved, the opposed marginal surface 43 of the wedge block is brought into snug engagement with inclined or slanted vertical step 22*a* of the stepped shaped rail 22 while the opposite margin 39' is caused to be snugly engaged with inclined or slanted vertical step 23*a* of the stepped shaped rail or side 23.

Figure 5:
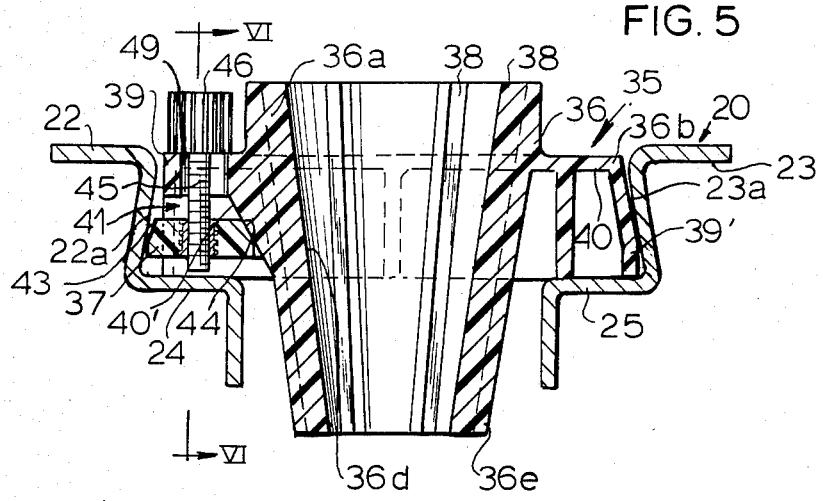
FIG. 5 is a cross-sectional view taken substantially on the line V—V looking in the direction indicated by the arrows as seen in FIG. 3.
Figure 6:
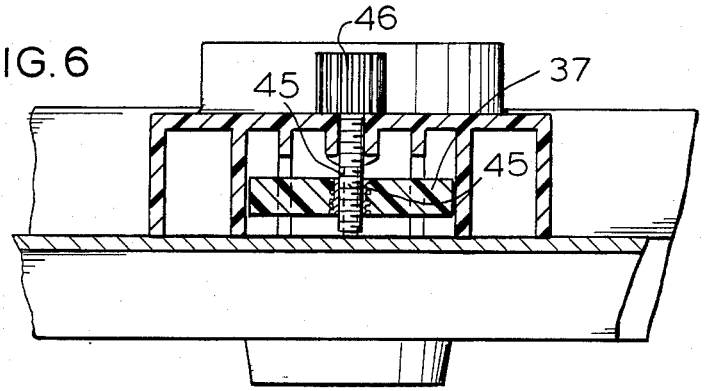
FIG. 6 is an enlarged fragmentary partially sectioned view as viewed on the line VI—VI looking in the direction indicated by the arrows as seen in FIG. V.
Figure 7:
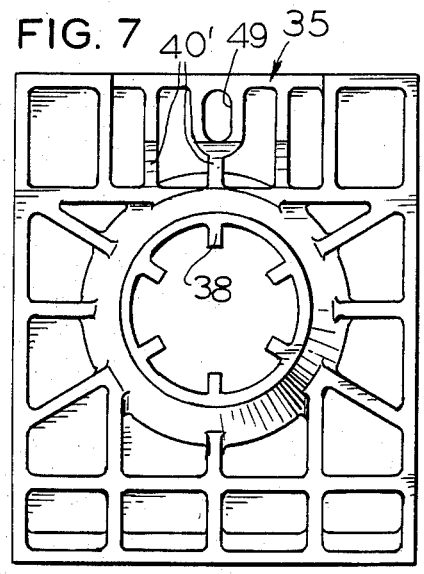
FIG. 7 is a bottom plan view of the toolholder illustrated above.

The clamp action that is exerted by the wedge block 37 is in an inside-out direction with respect to the side rails 22-23. In view of the inclined or slanted configuration of the steps 22*a* and 23*a*, the toolholder can be placed on the ledges 24 and 25 and thereby supported without interference from the flanges or steps 22*a* and 23*a*. When the screw 45 is unscrewed all the way the clamp block 37 can be easily lifted from the tray. When the screw 45 is rotated in an opposite direction, the wedge block 37 is caused to move radially of the screw 45 into snug locking engagement with the inclined or slanted wall surface 22*a*. As will be seen in FIG. 5, the wall surfaces 22*a* and 23*a* are so inclined as to extend in a converging direction in a direction away from tray support flanges or ledges 24 and 25. Also, the thumb screw extends freely through an unthreaded marginal hole 49 in the outer margin of the toolholder (FIG. 5).

The cart has a shelf structure 50 for storing articles at its forward end and a holder 51 at its opposite end to carry work cards, sheets or drawings.

It will further be appreciated that my toolholder can be made in a number of different sizes and the following represent few examples:

$\pi$50—tapered shank
$\pi$45—tapered shank
$\pi$40—tapered shank
$\pi$30—tapered shank
$2\frac{1}{4}''$ dia. straight shank
2" dia. straight shank
$1\frac{3}{4}''$ dia. straight shank The toolholders can be of any desired color such as plastic red, organge, yellow, green, blue, violet and white, respectively, and with the knurled head 46 being gold in color thus providing a very attractive appearing assemblage.

It will thus be understood that the clamp block can be effectively engaged with the tray in affixed assembly therewith. To this end, the distance between outer ends of the inclined converging wall surfaces 22*a* and 23*a* is such that the toolholder can be moved freely between outer ends of the wall surfaces 22*a* and 23*a* and then be supported on the support flanges or ledges 24 and 25. The distance between the inclined converging wall surfaces 22*a* and 23*a* at their inner ends in adjacency to the ledges 24 and 25 is greater and, hence, when the wedge block 37 is caused to move radially of the screw 45 upon the manipulation of the knurled end 46 of the screw the wedge block is then in fact engaged beneath a shoulder provided by the confronting inclined engaged wall surface 22*a*.

Other objects and features of the present invention will be more fully appreciated by those skilled in the art and it will, therefore, be appreciated that the embodiments illustrated are truly embodiments and that the invention can express itself in other forms not here illustrated, but which would be embraced by the following claims.

I claim:

1. In a portable cart mounted on wheels and having a frame with spaced upright walls mounted thereon, portable trays mounted between the spaced upright walls and means securing the trays in detachable assembly with the spaced upright walls, the improvement of a series of toolholders in mounted assembly on said portable trays, each of said toolholders having a central tubular section for receiving an elongated tool in mounted assembly therein, the toolholder having one of its sides provided with a recessed area, a wedge block mounted in said recessed area between the toolholder and the tray, the wedge block and the recessed area having inclined matching engaged surfaces slidable relative to one another, and a thumb screw mounted on said toolholder and extended through and engaged in threaded assembly with said wedge block such that rotation of said thumb screw causes relative movement between said inclined matching engaged surfaces to firmly wedge the wedge block and toolholder and tray in snug fixed assembly together, and rotation of the thumb screw in an opposite direction causes relative movement between said inclined surfaces to release the toolholder from the tray.

2. The cart of claim 1 further characterized by the tubular section having a frusto-conical shape for support of a tapered tool.

3. The cart of claim 1 further characterized by the thumb screw having a knurled head located on top of said toolholder in immediate adjacency to said tubular section.

4. The cart of claim 1 further characterized by the tubular section having an annular rim projection above a flat top surface of the toolholder, a lower tubular bottom ring portion positioned co-axially of said rim and formed integral as a one piece synthetic plastic extrusion.

5. The cart of claim 1 further characterized by the tubular section having a series of annularly spaced generally vertically extending ribs for engagement with an outer margin of the tool.

6. The cart of claim 1 further characterized by the front and rear upright walls of the cart having transversely spaced rows of vertically spaced slots, said tray having a pair of clips at each end engageable in selected pairs of said slots at each end of said tray for supporting the tray in variable selectable positions on said cart to enable the cart to transport a variety of different sized tools in toolholders mounted on the cart.

7. The cart of claim 1 further characterized by the tray having opposed C-shaped channel members with the open sides of the channels confronting one another, the tray having stepped rails with the toolholder resting thereon and with the clamp block being retainingly engageable with one of the rails upon actuation of the thumb screw to secure the toolholder in place.

8. The cart of claim 7 further characterized by the stepped side rails each having its opposite ends cutaway and projected into the C-shaped channels and being secured in welded assembly therewith.

9. The cart of claim 4 further characterized by the tubular section having longitudinally extending annularly arranged circumferentially spaced ribs and with the tool being adapted to engage the ribs when in assembly therewith.

10. The cart of claim 1 further characterized by the cart having a shelf structure for carrying articles mounted on one of said upright walls on a side opposite to the location of said tray.

11. The cart of claim 1 further characterized by a paper holder being mounted on one of said spaced upright walls on a wall side remote to said tray.

12. The cart of claim 3 further characterized by said thumb screw extending freely through an outer margin of said toolholder into said recessed area and there being threadingly engaged with said clamp block.

13. The cart of claim 1 further characterized by the trays having transversely spaced longitudinally extending sidewalls, ledges extending towards one another and connected at opposite ends with the sidewalls, the sidewalls being inclined and converging in a direction extending away from the ledges, the toolholder having a dimension permitting it to be supported on the ledges and to pass freely between the converging sidewalls, the clamp block being movable in the recessed area of the toolholder upon manipulation of the thumb screw effective to cause the clamp block to engage the opposing sidewalls of the tray.

14. The cart of claim 1 further characterized by the tray having opposed C-shaped channel members with the open sides of the channels confronting one another, the channels having lower legs each provided with a channel slot, and said means securing the trays and detachable assembly with the spaced upright walls comprising clips, the clips having attachment clip legs extended into locking assembly with the associated channel member and through the associated slot in the channel leg.

15. The cart of claim 1 further characterized by said means securing the trays in detachable assembly with the spaced upright walls comprising clips mounted on the ends of the trays and being dimensioned for hooked engagement with the spaced upright walls on the cart at opposite ends of the tray.

16. The cart of claim 15 further characterized by the spaced upright walls having spaced slots arranged for receiving said clips to support the trays on the upright walls.

17. The cart of claim 1 further characterized by the trays having transversely spaced longitudinally extending sidewalls, ledges extending towards one another and connected at opposite ends with the sidewalls, the sidewalls being inclined and converging in a direction extending away from the ledges, the distance between the outer ends of the converging sidewalls being smaller than the opposite ends of the sidewalls where the clamp block is engaged upon manipulation of the thumb screw effective to secure the toolholder in affixed assembly with the tray.

* * * * *